United States Patent [19]

Ochi et al.

[11] Patent Number: 4,984,519

[45] Date of Patent: Jan. 15, 1991

[54] DELAY CIRCUIT FOR USE IN ELECTRIC BLASTING SYSTEM

[75] Inventors: Koji Ochi, Iwamizawa; Masahide Harada, Sapporo; Kunio Kobayashi, Takasaki, all of Japan

[73] Assignees: Nippon Oil and Fats Company, Limited; Harada Electronics Industry; Hitachi Ltd., all of Japan

[21] Appl. No.: 309,157

[22] Filed: Feb. 13, 1989

[30] Foreign Application Priority Data

Feb. 16, 1988 [JP] Japan ..... 63-31869

[51] Int. Cl.[5] ..... F23Q 21/00

[52] U.S. Cl. ..... 102/217; 102/220

[58] Field of Search ..... 102/218, 220, 206, 217, 102/311

[56] References Cited

U.S. PATENT DOCUMENTS

| | | | |
|---|---|---|---|
| 3,862,602 | 1/1975 | Manning | 102/220 |
| 4,445,435 | 5/1984 | Oswald | 102/220 |
| 4,572,288 | 2/1986 | Kinley | 102/206 |
| 4,586,437 | 5/1986 | Miki et al. | 102/218 |
| 4,825,765 | 5/1989 | Ochi et al. | 102/206 |

FOREIGN PATENT DOCUMENTS

| | | | |
|---|---|---|---|
| 2260419 | 7/1973 | Fed. Rep. of Germany | 102/206 |
| 2916994 | 4/1979 | Fed. Rep. of Germany . | |
| 2160954 | 1/1986 | United Kingdom | 102/206 |

*Primary Examiner*—Charles T. Jordan
*Assistant Examiner*—Stephen Johnson
*Attorney, Agent, or Firm*—Parkhurst, Wendel & Rossi

[57] ABSTRACT

A delay circuit for use in an electric blasting system including a capacitor for storing electric energy supplied from an electric blaster, an actuation circuit for detecting the stop of voltage supply from the blaster to generate an actuation signal, a circuit for generating clock pulses, a circuit for counting a predetermined number of clock pulses in response to the actuation signal to generate an igniting signal, and a switching circuit for responding to the igniting signal to discharge the electric energy stored in the capacitor through an igniting resistor, the actuation circuit having a zener diode with a threshold voltage. When the voltage supply from the blaster is stopped and the voltage across the zener diode becomes lower than the threshold voltage, the zener diode is cut-off to generate the actuation signal.

5 Claims, 4 Drawing Sheets

DELAY CIRCUIT FOR USE IN ELECTRIC BLASTING SYSTEM

BACKGROUND OF THE INVENTION

Field of the Invention and Related Art Statement

The present invention relates to a delay circuit for use in an electric blasting system, and particularly to a delay circuit for use in an electric detonator and a fuse of delay type which are preferably used in a multi-step explosion in which a number of explosives are ignited at different timings A known electric detonator of delay type comprises an electric igniting portion to be connected between lead wires and a bridge wire, i.e. igniting resistor on which an igniting explosive is applied, a delaying explosive and a main explosive, said delaying explosive being arranged between the igniting explosive and main explosive. In this case, the main explosive is exploded in such a manner that the igniting explosive arranged in the igniting portion is firstly ignited by making the igniting portion conductive, this is followed by exploding the delaying explosive, and after a predetermined time period, the main explosive is exploded. However, since the delaying explosive is not exploded uniformly, it is difficult to control precisely the exploding time of the delaying explosive and the precision for controlling the delay time is limited and the delay time contains errors of 5%. Further, since the exploding time of the delaying explosive varies in dependence upon the secular variation of the explosive, per se, and the temperature variation when the electric detonator is used, there is a difficulty to use the electric detonator in a smooth blasting explosion, that is required to control the exploding timing of the delaying explosive precisely. Further, in case the explosions are carried out in a city or a suburb, the delay time of the delaying explosive in every step of the multi-step explosion has to be controlled finely in order to make the vibration and noise caused by the explosions minimum. In such case, it is necessary to establish the exploding timings of the delaying explosives more preciously in every step of the multi-step explosion. In the conventional electric detonator of delay type, however, the exploding timings of the delaying explosives in every step have large differences, and therefore there is a danger that explosives which should be exploded successively might be exploded at the same time, or in the reverse order.

In order to mitigate the above explained disadvantages, there has been suggested to combine an electric detonator of instantaneous type with an electric delay circuit in which pulses generated from an electric blaster are electrically delayed by means of an inductor or a capacitor provided in the delay circuit. There have been proposed two types of delaying system using the electric circuit, one of which is an analogue delaying system disclosed, for example, in Japanese Patent Publication Kokoku Sho 56-26,228, Japanese laid-open publication Nos. Kokai Sho 54-43,454 and Kokai Sho 62-91,799, and the other of which is a digital delaying system disclosed, for example, in Japanese Laid-open Publication Nos. Kokai Sho 57-142,498 and Kokai Sho 58-83,200.

In the analogue-type electric detonator of delay type, a delay circuit comprising resistor and capacitor is used, and the precision for controlling the exploding timing of the delay circuit depends on the precision of such electronic components constituting the delay circuit.

But, electronic components have nominal errors amounting to about several to several ten percentages, and thus it is not sufficient to use the electric detonator of delay type in the smooth blasting explosure or the explosure in a city.

In the digital-type electric detonator of delay type, an exploding timing is determined by counting clock pulses generated by an oscillating circuit installed in the delay circuit by means of a counter, so that the precision of exploding timing can be improved in comparison with the analogue-type electric detonator. However, when the oscillating circuit is formed by an R-C oscillator including resistor and capacitor, the frequency of the clock pulse depends on the precision of the resistor and capacitor provided therein, so that the precision of the frequency of the clock pulse generated by the R-C oscillating circuit is not so high and is generally worse than that of an oscillating circuit having a quartz vibrator or a ceramic vibrator. Such oscillating circuit having a quartz vibrator or a ceramic vibrator is generally used in a digital watch in which it is required to produce the clock pulse having a very high precision. If the electric detonator of delay type is constituted by such oscillating circuit having a quartz vibrator or a ceramic vibrator in combination with the counter, it is expected to increase the precision of the exploding timings of the delay explosion. However, in the oscillating circuit using the quartz or ceramic vibrator, the time of 200~300 ms is necessary until the oscillating circuit enters into the stable condition and produces the clock pulses having a desired frequency after the electric voltage is applied thereto. Thus, in case the electric detonator of delay type is constituted by such delay circuit in combination with the instantaneously exploding electric detonator, the time necessary to bring the oscillating circuit into the stable condition to generate the clock pulse having a desired frequency introduces an error in the exploding timings. Therefore, the R-C oscillating circuit was obliged to be used in the digital type electric detonator of delay type.

Not only the electric detonator of delay type but also the electric fuse of delay type has the same problem as that mentioned above.

In order to solve the above explained problem, the present inventors have disclosed a delay circuit for electric blasting in European Patent Publication No. EP 87308281.2 corresponding to U.S. co-pending application Ser. No. 97,834, in which the quartz vibrator or the ceramic vibrator is installed in the oscillating circuit and thus the exploding timing of delaying explosion can be determined highly precisely.

FIG. 1 is a circuit diagram showing the above mentioned known delay circuit for electric blasting This delay circuit 1 comprises a capacitor 2 for storing an electric energy supplied from a power supply source, an actuation circuit 3 for detecting that the supply of the electric energy from said power supply source to the capacitor 2 is stopped to produce an actuation signal, a clock pulse generating circuit 4 having a quartz vibrator or a ceramic vibrator which is energized with the electric energy stored in the capacitor 2 to generate clock pulses, a counting circuit 5 for initiating to count the clock pulses in response to said actuation signal and generating an igniting signal when a predetermined number of clock pulses has been counted thereby, and a switching circuit 6 for discharging therethrough the electric charge stored in the capacitor 2 to an ignition circuit in response to said ignition signal. The delay circuit 1 is connected to an igniting resistor 7 on which an igniting explosive *7a* is applied.

In such construction of the delay circuit for electric blasting mentioned above, the actuation circuit is so designed as to generate the actuation signal when the actuation circuit detects the timing at which the supply of energy from the power supply source is stopped, until which the quartz vibrator or the ceramic vibrator installed in the circuit has entered into the stable condition, so that the above mentioned problem can be removed. To this end, the actuation circuit 3 for detecting that the supply of electric energy from the power supply source is stopped comprises a current limiting resistor 9 and a diode 10 connected in series with a main conductor *8a*, potentiometer resistors 13, 15 connected across the main conductors *8a* and *8b*, a first transistor 14 having a base connected to a junction point of the resistors 11 and 12, a collector connected to the main conductor *8a* via a resistor 13 and an emitter connected to the main conductor *8b*, and a second transistor 16 having a base connected to the collector of the first transistor, a collector connected to the main conductor *8a* through a resistor 15 and an emitter connected to the main conductor *8b*. When a voltage is applied across input terminals $P_1$, $P_2$, a current flows through the resistors 11 and 12 and a base potential of the first transistor 14 becomes higher than an emitter potential, so that the first transistor 14 becomes conductive. Therefore, a base potential of the second transistor 16 becomes substantially equal to an emitter potential and the second transistor becomes non-conductive. In this manner, a potential at an output point Q of the actuation circuit 3 becomes substantially equal to the positive potential on the main conductor *8a*.

Across the main conductors *8a* and *8b* are connected capacitor 2, clock pulse generating circuit 4 and counting circuit 5. The clock pulse generating circuit 4 and counting circuit 5 initiate to operate when a voltage across the capacitor 2 exceeds the operation voltage, and the clock pulse generating circuit 4 starts to produce clock pulses.

In this actuation circuit 3, if the voltage applied to the actuation circuit 3 becomes zero when the supply of electric energy from the power supply source is stopped, the detonator can be operated precisely. That is to say, if the voltage applied to the circuit becomes zero within 0.1 ms after the supply of electric energy is stopped, the explosion could be highly precisely controlled.

However, in the practical circuit, there sometimes occurs a time delay until the applied voltage becomes down to the turn-off voltage (0.56 V) of the first transistor 16.

After the careful study, the inventors have proved the following causes of the operation time delay. One of the causes is a floating capacitance exiting across the input terminals $P_1$, $P_2$ of the delay circuit. For example, if the bus wires connected to the blaster or the pair of leg wires of the detonator are so long, there would exist the floating capacitance across the input terminals of the delay circuit. In such case, when the supply of electric energy from the blaster is stopped, the trailing edge of the waveform of the voltage would not become rectangular but sawtooth. Therefore, there would occur the operation time delay and the detonator could not be exploded at a precisely determined timing.

FIG. 2 is a graph representing a relation between the voltage applied across the input terminals $P_1$, $P_2$ of the delay circuit 1 and the operation time delay. As seen from the straight line a in FIG. 2, even when the floating capacitance existing in the delay circuit is small, it takes about 35 ms until the voltage of 3.1 V appearing across the input terminals at a reference time becomes lower than the turn-off voltage 0.56 V of the first transistor 14. And, when the floating capacitance is large, it takes 5,207 ms as shown by the straight line b in FIG. 2.

It has been further proved that the other cause is the non-sufficient insulating state between the input terminals of the delay circuit. That is to say, if a moisture is adhered to an insulating material provided between the input terminals $P_1$, $P_2$, the input terminals are not insulated sufficiently from each other, and the electrolysis would be occurred therebetween due to the voltage applied from the blaster. As a result, an electromotive force of about 0.8 V would be sometimes generated across the input terminals. In this case, even if the supply of electric energy from the blaster is stopped, this voltage of 0.8 V would be still remained, and therefore the actuation signal would not be generated until the voltage across the input terminals becomes lower than the minimum voltage of, for example, 0.6 V, at which the actuation circuit generates the actuation signal, and thus there occurs the operation time delay.

In general, it is required to control the explosion timing precisely with an allowable error of about several tens to one hundred milli-seconds. Therefore, the operation time delay stated in the above is a great problem in a practical viewpoint.

SUMMARY OF THE INVENTION

The present invention has for its object to provide a novel and useful electric delay circuit for use in electric blasting system, which can control the explosion timing in an accurate and stable manner by correcting or compensating the operation time delay caused by the voltage remained across the input terminals due to the fact that the input terminals are not insulated sufficiently and the floating capacitance exists between the input terminals.

According to the invention, a delay circuit for use in electric blasting system comprises:

a capacitor for storing an electric energy supplied from a power supply source;

an actuation circuit including a voltage threshold element which is cut-off when a terminal voltage applied to the actuation circuit becomes lower than a given threshold voltage and generating an actuation signal when the terminal voltage decreases to the threshold voltage;

a clock pulse generating circuit energized with the energy stored in the capacitor and generating clock pulses;

a counting circuit for initiating to count the clock pulses in response to said actuation signal and producing an igniting signal when a predetermined number of clock pulses are counted; and a switching circuit for discharging the electric charge stored in the capacitor in response to said igniting signal.

In the delay circuit according to the invention, there is provided the element having a given threshold voltage (hereinafter "voltage threshold element" will be used) which is cut-off when the terminal voltage thereof becomes lower than the given threshold voltage, so that when the supply of electric energy from the power supply source is stopped and the voltage across the actuation circuit becomes lower than the threshold voltage, the actuation signal is generated always at a correct timing. Thus, the operation time differences of the electric detonators caused by the non-sufficient insulating and the floating capacitance can be corrected.

DETAILED DESCRIPTION OF THE PREFERRED EMBODIMENT

Figure 3:
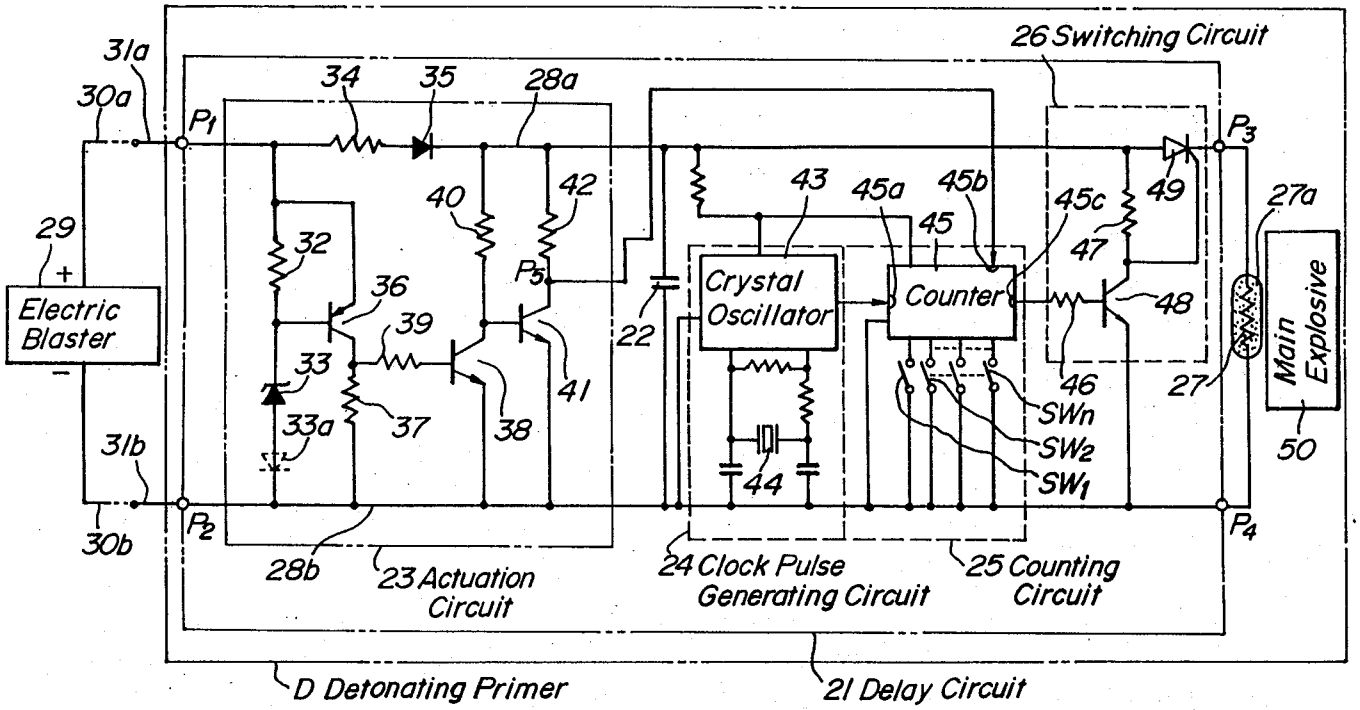
FIG. 3 is a circuit diagram depicting an embodiment of the delay circuit according to the invention.

FIG. 3 is a circuit diagram showing the detail construction of an embodiment of the delay circuit 21 according to the present invention. The present delay circuit is installed in an electric detonator to form a delay type detonating primer D.

In this embodiment, there are provided a capacitor 22 for storing the electric energy supplied from an electric blaster 29 via bus wires 30*a*,30*b* and a pair of leg wires 31*a*, 31*b*, an actuation circuit 23 for detecting that the supply of electric energy is stopped and then generating an actuating signal, a clock pulse generating circuit 24 which is energized by the energy stored in the capacitor 22 for generating clock pulses when the terminal voltage of said capacitor 22 exceeds a given value, a counter circuit 25 for counting the clock pulses generated by the clock pulse generating circuit 24 and generating an igniting signal when a given number of clock pulses is counted thereby, and a switching circuit 26 for discharging the electric energy stored in the capacitor 22 in response to said igniting signal generated by the counting circuit 25 through an igniting resistor 27 on which an igniting explosive 27*a* is applied. In the present embodiment, the clock pulse generating circuit 24 is composed of a crystal oscillator 43 having a quartz vibrator 44, and the counting circuit 25 comprises a counter 45 to which are connected a plurality of switches $SW_1$, $SW_2$, . . . $SW_n$.

The actuation circuit 23 will be explained more detail in the following. The actuation circuit 23 comprises a series circuit consisting of a resistor 32 and a zener diode 33, which series circuit is connected across main conductors 28*a* and 28*b* connectable to bus wires 30*a* and 30*b* via a pair of leg wires 31*a* and 31*b* and a series circuit of resistor 34 and diode 35 which is connected in series with the main conductor 28*a* in the forward direction. The actuation circuit 23 further includes a PNP-type transistor 36 having an emitter connected to a junction point between the resistors 32 and 34, a base connected to a junction point between the resistor 32 and the zener diode 33, and a collector connected to the main conductor 28*b* via a resistor 37, an NPN-type transistor 38 having a base connected to a junction point between the collector of the transistor 36 and the resistor 37 via a resistor 39, a collector connected to the main conductor 28*a* via a resistor 40, and an emitter directly connected to the main conductor 28*b*, and an NPN transistor 41 having a base connected to a junction point between the collector of the transistor 38 and the resistor 40, a collector connected to the main conductor 28*a* via a resistor 42 and an emitter directly connected to the main conductor 28*b*.

When the electric blaster 29 is actuated, a constant voltage is applied across the input terminals $P_1$ and $P_2$ of the actuation circuit 23. When the applied voltage is higher than the zener voltage of the zener diode 33, the zener diode 33 is made conductive and an electric current flows through the resistor 32. And, the base potential of the transistor 36 becomes lower than the emitter potential, thus the transistor 36 is made conductive. It should be noted that the zener voltage of the zener diode 33 is established at a value higher than 1 V, preferably 2 V. Since the electric current flows through the resistor 37, the base potential of the transistor 38 becomes higher than the emitter potential, and thus the transistor 38 is also made conductive. Therefore, the base potential and emitter potential of the transistor 41 become substantially equal to each other, so that the transistor 41 is remained non-conductive and the electric potential at an actuating signal output terminal $P_5$ which is connected to the collector of the transistor 41 becomes substantially equal to the electric potential on the main conductor 28*a*. The clock pulse generating circuit 24 and counting circuit 25 are connected across the main conductors 28*a* and 28*b*.

The clock pulse generating circuit 24 is composed of the crystal oscillator 43 having the quartz vibrator 44, and the counting circuit 25 is composed of the counter 45 to which a plurality of switches $SW_1$, $SW_2$ . . . $SW_n$ are connected. By closing a desired switch $SW_i$ of these switches, a count value of the counter corresponding to a desired delay time can be preset at will. The clock pulse generating circuit 24 and the counting circuit 25 are actuated when the terminal voltage of the capacitor 22 exceeds their operating voltages. The clock pulse generating circuit 24 generates clock pulses and the counter 45 begins to count the clock pulses received at its input terminal 45*a*. The output terminal $P_5$ of the actuation circuit is connected to a reset terminal 45*b* of the counter 45, so that when the actuating signal supplied from the output terminal $P_5$ of the actuation circuit 23 to the counter 45 becomes high, the counting circuit is reset.

That is to say, when the potential of the output terminal $P_5$ is equal to the potential of the main conductor 28*a*, the counting operation is inhibited. Therefore, in this case, the counting operation is not started and thus the switching circuit 26 is not made conductive.

Next, after the supply of the electric energy from the blaster 29 to the capacitor 22 has been stopped, the voltage applied across the input terminals $P_1$ and $P_2$ becomes lower than the zener voltage of the zener diode 33, and the zener diode 33 is cut-off. Therefore, the electric current does not flow through the resistor 37, so that the base potential of the transistor 38 becomes substantially equal to the emitter potential and thus the transistor 38 is made nonconductive. Therefore, the base potential of the transistor 41 becomes higher than the emitter potential and thus the transistor 41 is made conductive. As a result, the electric potential at the output terminal $P_5$ becomes low, i.e. becomes equal to the electric potential on the main conductor 28*b*. In this case, the reset condition of the counting circuit 25 is released and the counting operation is started. When the counting circuit 25 has counted a predetermined number of clock pulses set by the switch $SW_i$, the igniting signal is supplied to the switching circuit 26. The switching circuit 26 comprises resistors 46, 47, transistor 48 and thyristor 49. When the ignition pulse supplied from the output terminal 45c of the counter 45 is applied via the resistor 46 to a base of the transistor 48, the transistor is made conductive. Then a gate potential of the thyristor 49 becomes lower than an anode potential and the thyristor is turned on. Then the electric charge stored in the capacitor 22 is discharged through the thyristor 49 and igniting resistor 27 connected to output terminals of the delay circuit 21. Therefore, the temperature of the igniting resistor 27 is increased abruptly and the igniting explosive 27a applied around the igniting resistor is ignited. Subsequent to this, a main explosive 50 provided in the primer D is exploded.

Figure 1:
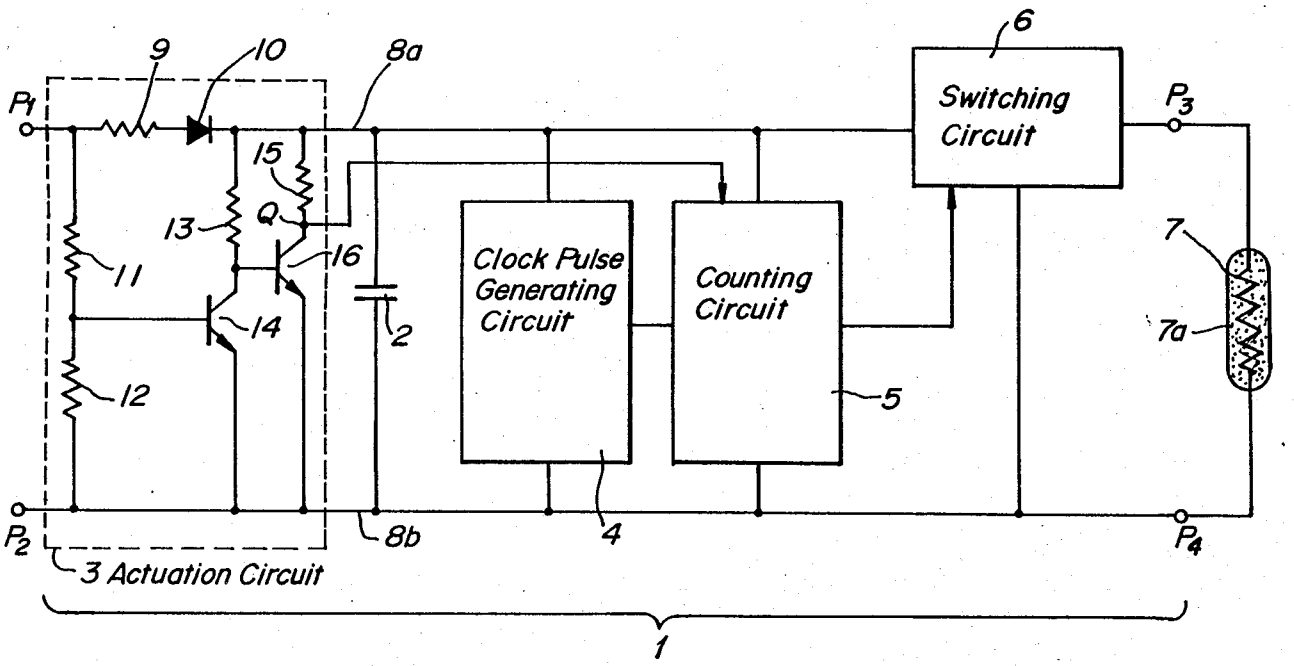
FIG. 1 is a circuit diagram showing the known delay circuit for use in electric blasting system.
Figure 2:
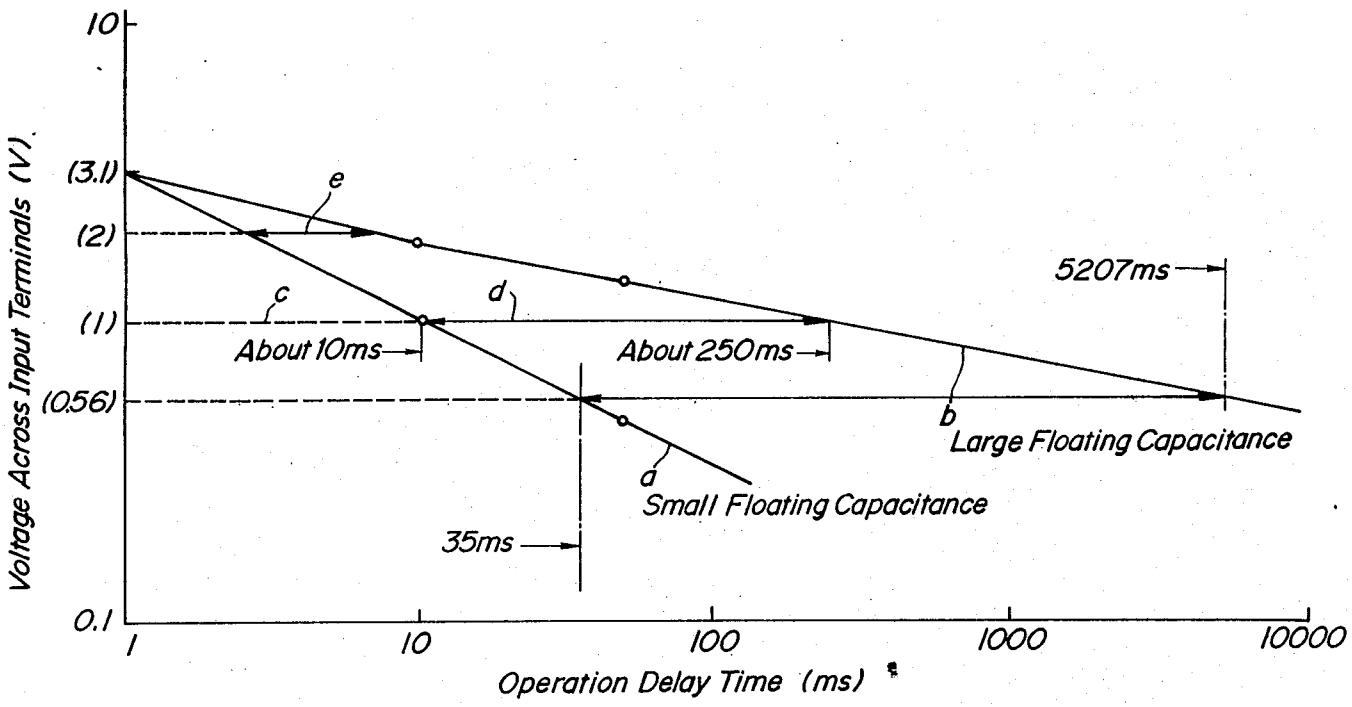
FIG. 2 is a graph representing a relation between the input terminal voltage of the delay circuit and the operation delay time.

According to the delay circuit for electric detonator of the present embodiment, since the turn-off voltage of the transistor 36 is made 1 V, in the other words, the zener voltage of the zener diode 33 is set at 1 V, the operation delay time is decreased to about 10 ms when the floating capacitance existing across the input terminals $P_1$, $P_2$ is small. And even when the floating capacitance is large, it can be limited to about 250 ms as represented by horizontal broken line c and solid line d in FIG. 2. More preferably, if the zener voltage of the zener diode 33 is set at 2 V, the time delay can be decreased less than 10 ms even when the floating capacitance is large as illustrated by a line e in FIG. 2, and thus the detonator can be operated highly precisely. The zener voltage has to be determined to be lower than the lowest threshold voltage of the detonator (for example 3~30 V) under taking into account of the time constant of the capacitor when the electric energy stored therein is discharged and the desired precision of exploding timing.

The present invention is not limited to the embodiment explained above, but may be modified in various ways. For example, in the actuation circuit 23 of the above mentioned embodiment, if a diode 33a is connected in series with the zener diode 33, it could be prevented that the elements constituting the delay circuit might be broken when a voltage having a reverse polarity is accidentally applied to the delay circuit.

Figure 4:
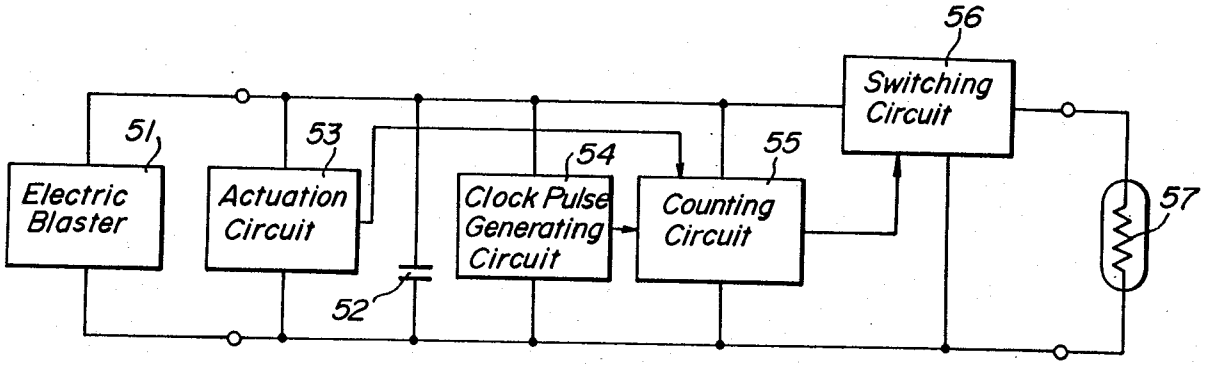
FIG. 4 is a block diagram showing the construction of an embodiment of the delay circuit for use in a delay type fuse.

Further, the delay circuit according to the invention may be equally installed in the detonating fuse. Then, the detonating fuse may be used as the delay type fuse. FIG. 4 is a block diagram showing the detonating fuse in which the delay circuit according to the invention is installed. The detonating fuse comprises a capacitor 52 for storing the electric energy supplied from an electric blaster 51, an actuation circuit 53 for detecting that the supply of the electric energy is stopped and generating an actuating signal, a clock pulse generating circuit 54 which is energized with the energy stored in the capacitor 52 and generates clock pulses when the terminal voltage of the capacitor 52 exceeds the given value, a counting circuit 55 for counting these clock pulses and supplying an igniting signal when a predetermined number of clock pulses are counted, a switching circuit 56 for discharging the electric energy stored in the capacitor 52 to an igniting resistor 57 when the igniting signal is supplied to the switching circuit. These circuits installed in the detonating fuse have the same configuration as those of the aforementioned embodiment of the detonator of delay type shown in FIG. 3.

In the above mentioned embodiments, the zener diode is used as a voltage threshold element, but another voltage threshold elements may be used to produce the actuation signal when the voltage applied across the actuation circuit decreases to a predetermined voltage.

As explained in detail in the above, in the present invention, since the voltage threshold element such as zener diode is provided in the actuation circuit, the actuation signal is produced when the terminal voltage of the delay circuit becomes lower than the predetermined value by making the voltage threshold element non-conductive at this time. Therefore, it is possible to correct the error in the delay time of explosion caused by the non-sufficient insulating between the input terminals of the delay circuit or the floating capacitance existing between the input terminals, and thus the electric detonator of delay type can be controlled precisely.

What is claimed is:

1. A delay circuit for use in an electric blasting system comprising:

a capacitor for storing an electric energy supply from a power supply source;

an actuation circuit including a voltage threshold element which is cut-off when a terminal voltage applied to the actuation circuit becomes lower than a threshold voltage of greater than one volt and generating an actuation signal when the terminal voltage decreases to the threshold voltage;

a clock pulse generating circuit energized with the energy stored in the capacitor and generating clock pulses when so energized;

a counting circuit for initiating to count the clock pulses in response to said actuation signal and producing an igniting signal when a predetermined number of said clock pulses are counted; and a switching circuit for discharging the electric charge stored in the capacitor in response to said igniting signal.

2. A delay circuit according to claim 1, wherein said actuation circuit comprises a zener diode as said voltage threshold element.

3. A delay circuit according to claim 2, wherein said clock pulse generating circuit comprises a high precision oscillator including a quartz vibrator or a ceramic vibrator.

4. A delay circuit for use in an electric blasting system in which the power supply source is constituted by an electric blaster according to claim 3, wherein the delay circuit further comprises first and second input terminals to be connected to the electric blaster via bus wires, first and second main conductors each connected to said first and second input terminals, said capacitor, said actuation circuit, said clock pulse generating circuit and said counting circuit being connected across said first and second main conductors and said switching circuit being connected in series with said first main conductor, and first and second output terminals, said first output terminal being connected to an output terminal of said switching circuit and said second output terminal being connected to said second main conductor.

5. A delay circuit according to claim 4, wherein said actuation circuit comprises a first series circuit of a first resistor and said zener diode connected across said first and second main conductors, a second series circuit of a diode and a second resistor connected in series with said first main conductor such that current is permitted to flow in a forward direction, a first transistor having an emitter connected to a junction point of said first and second resistors, a base connected to a junction point of said first resistor and said zener diode, and a collector connected to said second main conductor via a third resistor, a second transistor having a base connected to a junction point of said collector of the first transistor and said third resistor via a fourth resistor, a collector of said second transistor connected to said first main conductor via a fifth resistor, and an emitter of said second transistor connected to said second main conductor, and a third transistor having a base connected to a junction point of the collector of said second transistor and said fifth resistor, a collector of said third transistor connected to said first main conductor via a sixth resistor and an emitter of said third transistor connected to said second main conductor, wherein said actuation signal is derived from a junction point between the collector of said third transistor and said sixth transistor.

* * * * *